US006663366B2

(12) United States Patent
Okada et al.

(10) Patent No.: US 6,663,366 B2
(45) Date of Patent: Dec. 16, 2003

(54) COMPRESSOR HAVING COOLING PASSAGE INTEGRALLY FORMED THEREIN

(75) Inventors: Hiroshi Okada, Anjo (JP); Sota Shibasaki, Kariya (JP); Kazuhiro Ojika, Nagoya (JP); Mamoru Shimoda, Toyoake (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/136,125

(22) Filed: May 1, 2002

(65) Prior Publication Data

US 2002/0172612 A1 Nov. 21, 2002

(30) Foreign Application Priority Data

May 16, 2001 (JP) ..... 2001-146504

(51) Int. Cl.[7] ..... F01C 21/04
(52) U.S. Cl. ..... 418/83; 418/101; 418/201.1
(58) Field of Search ..... 418/83, 101, 201.1

(56) References Cited

U.S. PATENT DOCUMENTS 2,755,990 A * 7/1956 Nilsson et al. ..... 418/101
4,984,974 A * 1/1991 Naya et al. ..... 418/87
5,413,467 A * 5/1995 Suzuki ..... 418/201.1
5,924,855 A * 7/1999 Dahmlos ..... 418/201.1
6,394,777 B2 * 5/2002 Haavik ..... 418/101

FOREIGN PATENT DOCUMENTS

JP A5-231362 9/1993
JP 10-159762 6/1998

* cited by examiner

*Primary Examiner*—Thomas Denion
*Assistant Examiner*—Theresa Trieu
(74) *Attorney, Agent, or Firm*—Harness, Dickey & Pierce, PLC

(57) ABSTRACT

A compressor is composed of a pair of rotors engaging with each other and a driving mechanism having plural gears for driving the pair of rotors. The pair of rotors is disposed in a rotor chamber and the driving mechanism in a gear chamber, both chambers being separated by a separating wall. Fluid such as air is introduced into the rotor chamber from an inlet port and compressed therein, and the compressed air is delivered through an outlet port formed at a position close to the driving mechanism. A cooling water passage is formed at a bottom portion of the gear housing to cool lubricant encapsulated in a gear chamber. Additional cooling water passages may be made to further cool the components of the compressor.

10 Claims, 6 Drawing Sheets

COMPRESSOR HAVING COOLING PASSAGE INTEGRALLY FORMED THEREIN

CROSS-REFERENCE TO RELATED APPLICATION

This application is based upon and claims benefit of priority of Japanese Patent Application No. 2001-146504 filed on May 16, 2001, the content of which is incorporated herein by reference.

BACKGROUND OF THE INVENTION

1. Field of the Invention

The present invention relates to a compressor for compressing fluid, the compressor having a male-rotor and a female rotor engaging with each other. The present invention is applicable to compressors such as a screw-type compressor and a roots-type compressor.

2. Description of Related Art

In a compressor having a pair of rotors and a driving mechanism for driving the pair of rotors in synchronism with each other, a gear housing containing the driving mechanism therein is connected to a rotor housing containing the rotors therein. In case an inlet port for introducing fluid is formed in the rotor housing at a position close to the driving mechanism contained in the gear housing, lubricant in the gear housing tends to leak into the rotor housing due to a negative pressure developed in the rotor housing at a vicinity of the driving mechanism through a bearing supporting the driving mechanism. To avoid such a problem, the inlet port may be formed at a position far from the driving mechanism and the outlet port at a position close to the driving mechanism. In this manner, a positive pressure is developed in the rotor housing at a vicinity of the driving mechanism, and thereby leakage of the lubricant in the gear housing into the rotor housing can be avoided.

In this structure, however, the compressed fluid at a high temperature flows out from the outlet port formed at a vicinity of the driving mechanism. Therefore, the heat of the compressed fluid is transferred to the driving mechanism, and thereby the driving mechanism is heated to a high temperature. Accordingly, the driving mechanism has to be made to be durable to a high temperature. This results in a high manufacturing cost of the driving mechanism.

SUMMARY OF THE INVENTION

The present invention has been made in view of the above-mentioned problem, and an object of the present invention is to provide an improved compressor having the outlet port formed at a vicinity of the driving mechanism, in which the driving mechanism and other components are effectively cooled, and temperature of the compressed fluid delivered from the outlet port is lowered at the same time.

The compressor is composed of a pair of rotors rotating in engagement with each other and a driving mechanism for driving the pair of rotors. The pair of rotors is disposed in a rotor chamber formed in a rotor housing, and the driving mechanism constituted by plural gears is disposed in a gear chamber formed in a gear housing. The rotor chamber and the gear chamber are separated from each other by a separating wall of the rotor housing. Lubricant for lubricating the driving mechanism is encapsulated in the gear chamber. An inlet port for introducing fluid such as air into the rotor chamber is formed in the rotor housing at a position remote from the driving mechanism, while an outlet port for delivering compressed fluid at a high temperature is formed in the rotor housing at a position close to the driving mechanism.

The pair of rotors is rotated by a rotational torque transferred from a driving shaft via the driving mechanism. According to rotation of the pair of rotors, fluid is introduced into the rotor chamber from the inlet port and compressed therein, and the compressed fluid is delivered from the output port.

A first cooling water passage through which cooling water of an internal combustion engine circulates is formed in the gear housing at its bottom portion. The first passage is positioned at a vicinity of the outlet port. The lubricant in the gear chamber is effectively cooled by the cooling water flowing through the first cooling water passage, and thereby the driving mechanism and bearings supporting rotor shafts are cooled by the lubricant. The compressed fluid at a high temperature delivered from the outlet port is cooled by the cooling water at the same time.

A second cooling water passage communicating with the first cooling water passage may be additionally formed around the bearings fixed to the separating wall for supporting the rotor shafts. The bearings heated to a high temperature by the compressed fluid in the rotor chamber is effectively cooled by cooling water flowing through the second passage. Further, a third cooling water passage communicating with the first passage through the second passage may be formed at a bottom portion of the rotor housing, so that the compressed fluid in the rotor chamber is further cooled by the cooling water. Further, a communicating passage connecting a bearing hole containing the bearings therein and the gear chamber may be formed through the rotor housing to sufficiently supply lubricant in the gear chamber to the bearing hole.

According to the present invention, the driving mechanism in the gear chamber, the bearings supporting the rotor shafts and the compressed fluid in the rotor chamber are effectively cooled, and thereby durability of the compressor is improved. The cooling water passage or passages can be formed in the housings in an inexpensive manner.

Other objects and features of the present invention will become more readily apparent from a better understanding of the preferred embodiments described below with reference to the following drawings.

DETAILED DESCRIPTION OF THE PREFERRED EMBODIMENTS

Figure 1:
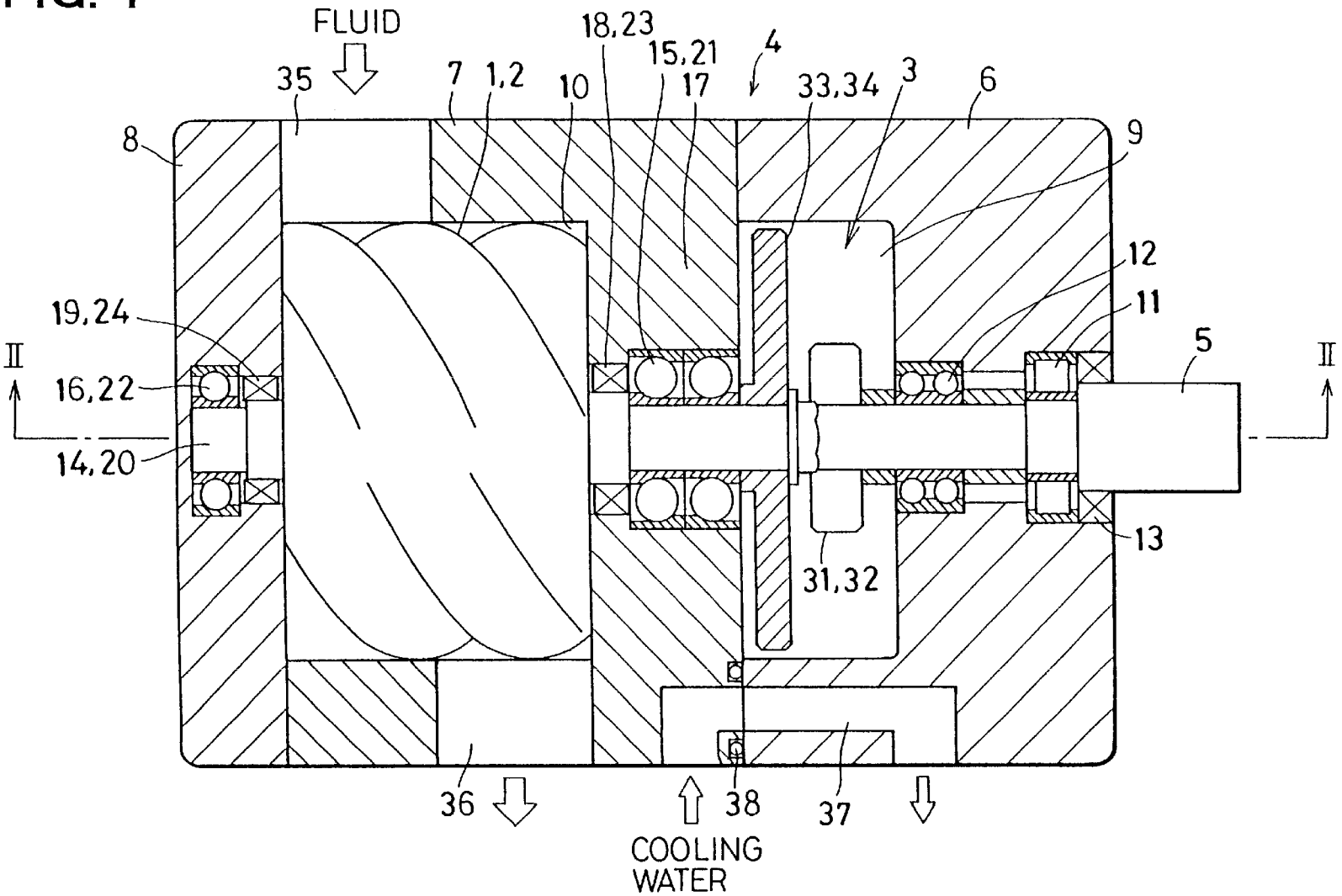
FIG. 1 is a cross-sectional view showing a compressor as a first embodiment of the present invention.
Figure 2:
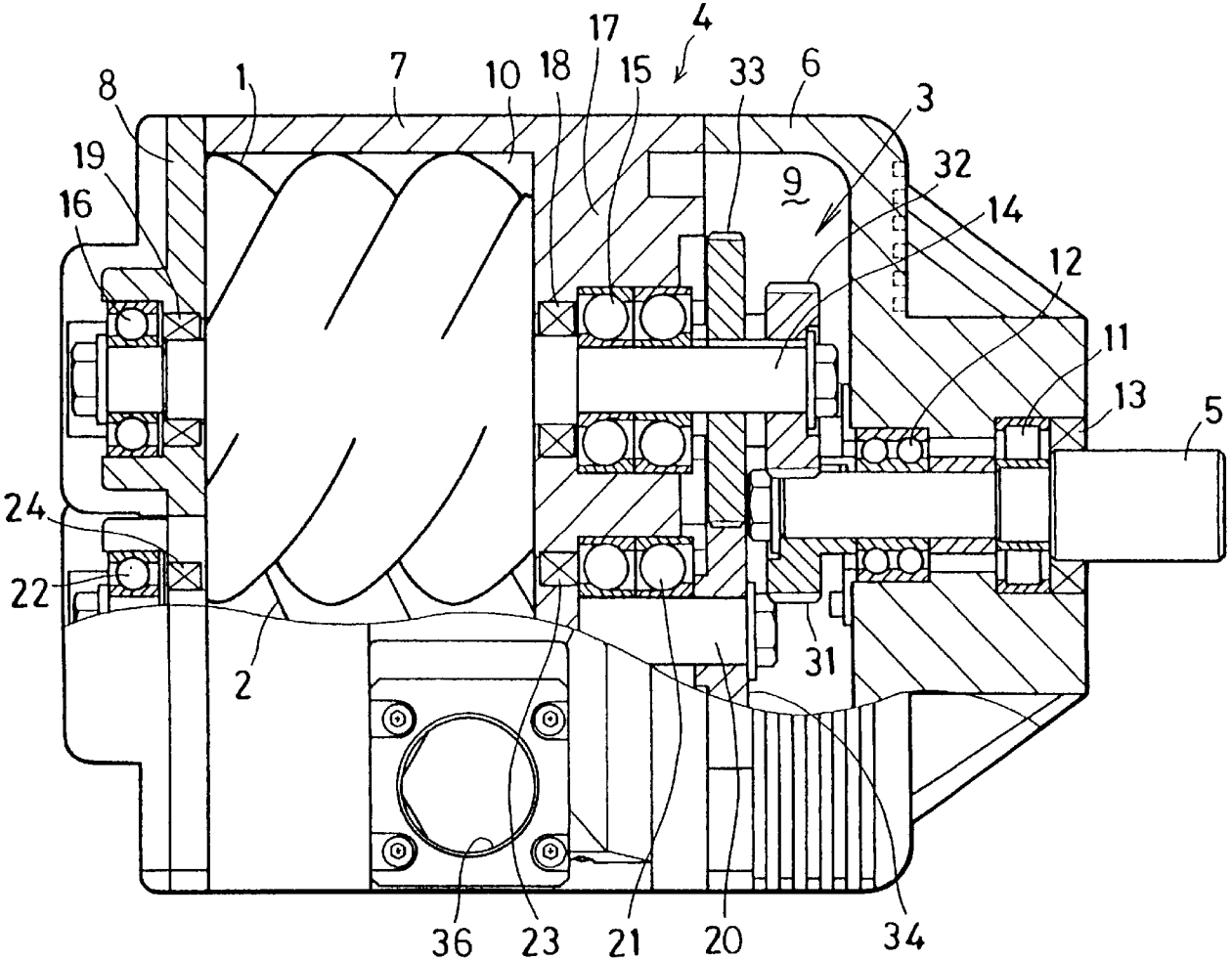
FIG. 2 is a cross-sectional view showing the same compressor as shown in FIG. 1, taken along line II—II of FIG. 1.
Figure 3:
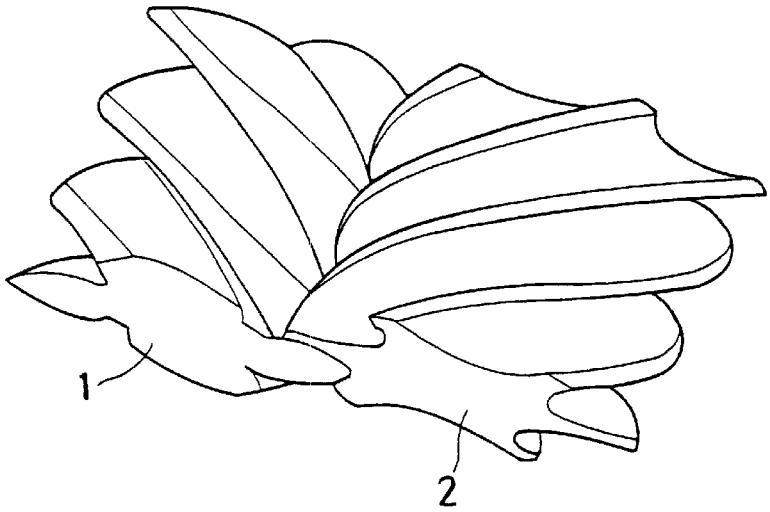
FIG. 3 is a perspective view showing a pair of rotors used in the compressor.

A first embodiment of the present invention will be described with reference to FIGS. 1–3. For an explanation purpose, a left side of FIGS. 1 and 2 is referred to as a front side of the compressor, while a right side thereof is referred to as a rear side of the compressor. The compressor is composed of a pair of rotors 1, 2 and a driving mechanism 3 for driving the pair of rotors, both contained in a casing 4. The casing 4 consists of a gear housing 6, a rotor housing 7 and an end cover 8, all firmly connected by through-bolts (not shown) or the like. A gear chamber 9 is formed in the gear housing 6, and the driving mechanism 3 is disposed in the gear chamber 9. Lubricant such as engine oil is also encapsulated in the gear chamber 9 so that the lubricant is splashed to gears constituting the driving mechanism. The rotor housing 7 forms a rotor chamber 10 in which the pair of rotors 1, 2 are contained. As shown in FIG. 3, the pair of rotors 1, 2 consists of a male-rotor 1 and a female rotor 2 engaging with each other, both having plural screw blades. In FIG. 1, both the male-rotor shaft 14 and the female-rotor shaft 20 are shown in an overlapping situation, while both rotor shafts (14, 20) are shown in parallel in FIG. 2.

Now, referring to FIGS. 1 and 2 together, the structure of the compressor will be described in detail. A driving shaft 5 is rotatably supported by a pair of bearings 11, 12 fixed in the gear housing 6. An oil seal 13 is provided outside the bearing 11 to prevent lubricant supplied to both bearings 11, 12 from flowing out from the gear housing 6. The male-rotor shaft 14 is supported by a pair of bearings 15 and 16. The bearing 15 is fixed to a separating wall 17 of the rotor housing 7 which separates the rotor chamber 10 from the gear chamber 9, while the bearing 16 is fixed to the end cover 8. An oil seal 18 for preventing lubricant supplied to the bearing 15 from leaking to the rotor chamber 10 is disposed in the separating wall 17. Another oil seal 19 is disposed in the end cover 8 next to the bearing 16 to prevent lubricant leakage into the rotor chamber 10. The female-rotor shaft 20 is supported by a pair of bearings 21 and 22. The bearing 21 is fixed to the separating wall 17 while the bearing 22 is fixed to the end cover 8. Oil seals 23 and 24 are disposed in the separating wall 17 and the end cover 8, respectively, to prevent lubricant leakage from the bearings 21, 22 into the rotor chamber 10.

A rotational torque of the driving shaft 5 is transferred to the male-rotor shaft 14 and the female-rotor shaft 20 through the driving mechanism 3. The driving mechanism 3 includes four gears, a first gear 31, a second gear 32, a third gear 33 and a fourth gear 34. The rotational torque of the driving shaft 5 is transferred to the male rotor shaft 14 via the first gear 31 fixed to the driving shaft 5 and the second gear 32 fixed to the male-rotor shaft 14. The rotational torque of the male rotor shaft 14 is transferred to the female-rotor shaft 20 via the third gear 33 fixed to the male-rotor shaft 14 and the fourth gear 34 fixed to the female-rotor shaft 20. The third gear 33 and the fourth gear 34 constitute timing gears for rotating the female-rotor shaft 20 in synchronism with the male-rotor shaft 14.

The first rotor 1 and the second rotor 2, each having plural screw blades, are shown in FIG. 3. When the both rotors 1, 2 rotate in engagement with each other, fluid such as air is introduced into the rotor chamber 10 through an inlet port 35 formed in the rotor housing 7 at the front side (at a position remote from the driving mechanism 3). The introduced fluid is compressed in the rotor chamber 10 and moves from the front side to the rear side. The compressed fluid is delivered from an outlet port 36 formed in the rotor housing 7 at its bottom rear side (at a position close to the driving mechanism 3) at a predetermined rotational angle of the pair of rotors 1, 2.

As shown in FIG. 1, a cooling water passage 37 is formed in the gear housing 6 and partly in the separating wall 17. The cooling water passage 37 is connected to an engine-cooling water passage, so that the cooling water circulates through the cooling water passage 37. An O-ring 38 is disposed on a surface connecting the gear housing 6 and the rotor housing 7 to prevent cooling water leakage. The cooling water passage 37 is formed so that it is positioned at a bottom portion of the compressor when the compressor is mounted on a predetermined position. Heat of the lubricant staying at a bottom portion of the gear chamber 9 is transferred to the cooling water flowing through the cooling water passage 37.

Since the cooling passage 37 is located close to the bottom of the gear chamber 9 where the lubricant stays, the heat exchange between the lubricant and the cooling water is efficiently performed. The driving mechanism 3 is cooled by the cooled lubricant which is splashed to the gears of the driving mechanism according to the rotation thereof. Further, since the outlet port 36 is positioned close to the cooling water passage 37, the compressed fluid having a high temperature flowing out of the outlet port 36 is cooled by the cooling water. Cooling the outlet air also contributes lowering the temperature in the gear chamber 9.

In the first embodiment described above, the driving mechanism 3 disposed in the gear chamber 9 is effectively cooled by simply forming the cooling water passage 37 at the bottom portion of the gear housing 6, even though the outlet port 36 delivering the compressed fluid at a high temperature is formed close to the driving mechanism 3. Accordingly, a temperature-durability requirement for the driving mechanism 3 is alleviated thereby to reduce its manufacturing cost. In addition, the temperature of the compressed air delivered from the outlet port 36 is lowered at the same time.

Figure 4:
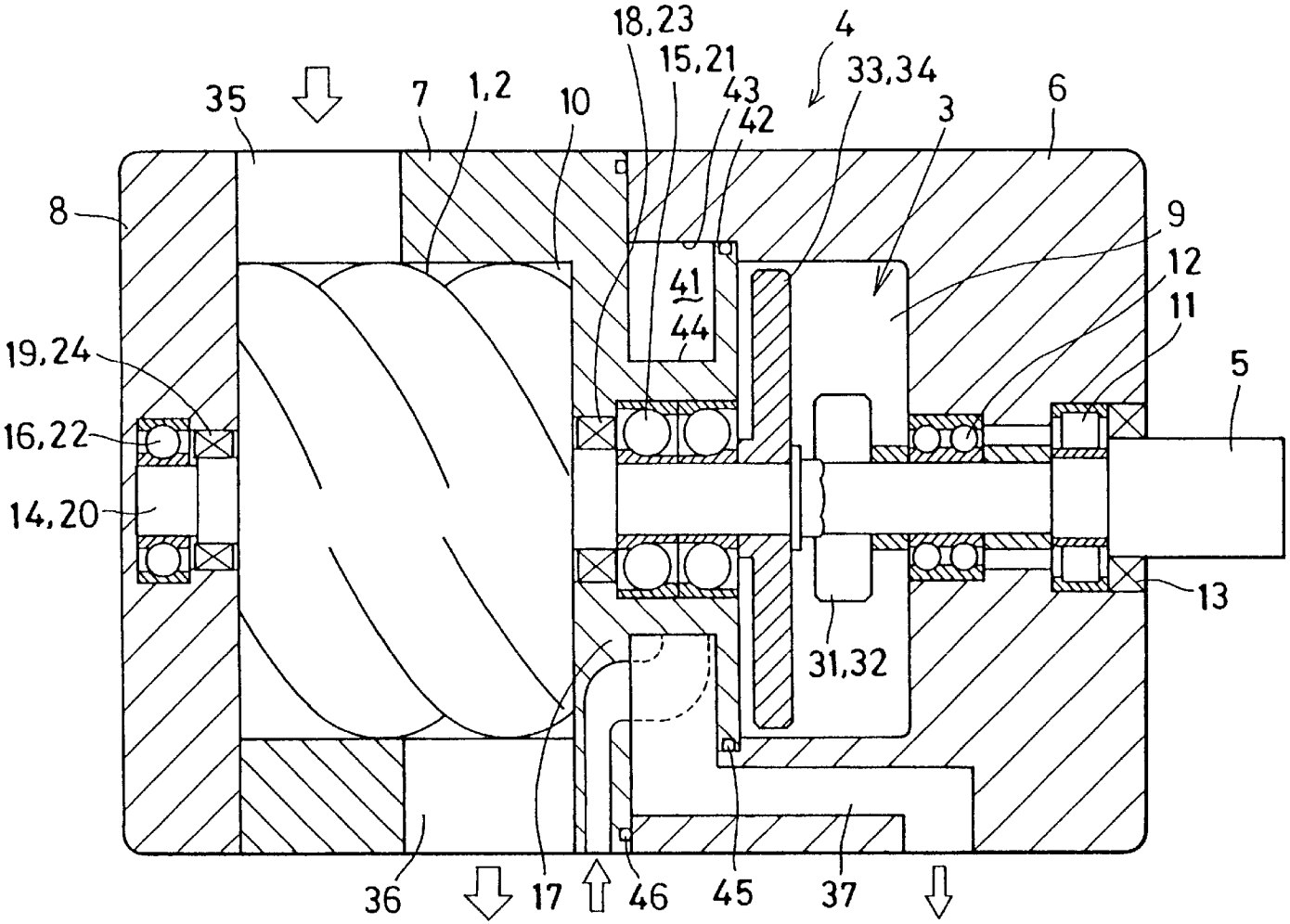
FIG. 4 is a cross-sectional view showing a compressor as a second embodiment of the present invention.

A second embodiment of the present invention will be described with reference to FIG. 4. In this embodiment, a second cooling water passage 41 is additionally formed between the rotor housing 7 and the gear housing 6 around the bearings 15, 21. Other structures are the same as those of the first embodiment. At the rear side of the rotor housing 7, a groove 44 and an end wall 42 are formed. On the other hand, a circumferential surface 43 are formed in the gear housing 6. The second cooling water passage 41 is formed by the groove 44, the end wall 42 and the circumferential surface 43 and is connected to the cooling water passage 37 so that the cooling water circulates through the cooling water passage 37 and the second cooling water passage 41. O-rings 45, 46 are disposed at portions connecting the rotor housing 7 and the gear housing 6 to prevent water leakage from the second cooling water passage 41. The second cooling water passage 41 forms an oval passage surrounding the bearing 15 supporting the male-rotor shaft 14 and the other bearing 21 supporting the female-rotor shaft 20.

The bearings 15, 21, temperature of which becomes high due to the compressed fluid at a high temperature, are effectively cooled down by the cooling water flowing through the second cooling water passage 41. Accordingly, the bearings 15, 21 are properly lubricated by preventing lubricant evaporation, and the oil seals 18, 23 disposed at a vicinity of the bearings 15, 21 are protected from an excessive temperature rise. Further, the temperature of the compressed air delivered from the outlet port 36 is lowered because the separating wall 17 of the rotor housing 7 is also cooled down by the cooling water flowing through the second cooling water passage 41.

Figure 6:
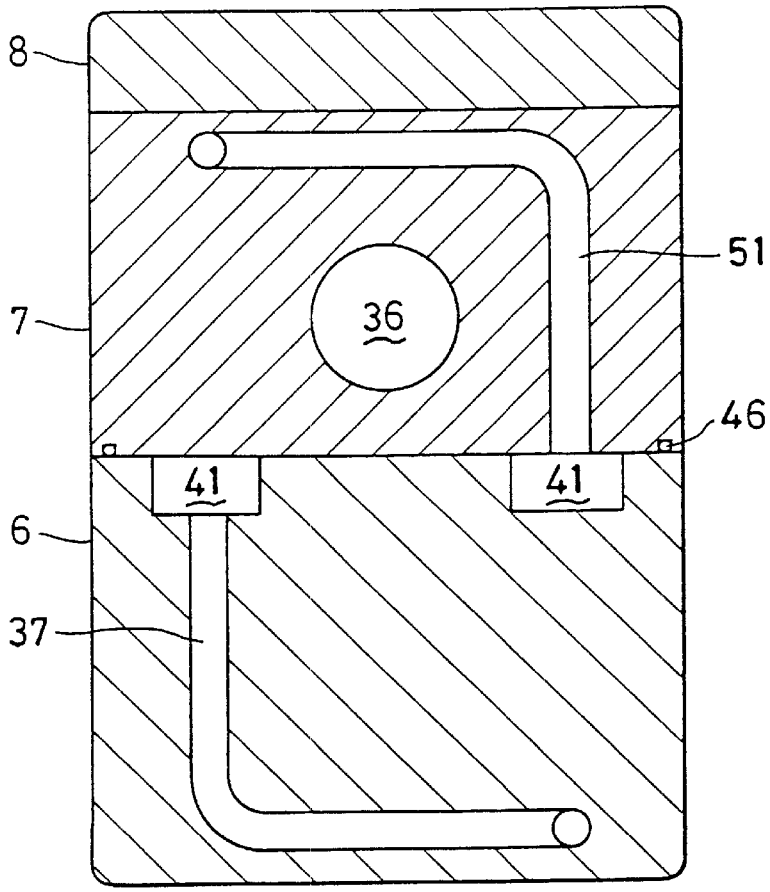
FIG. 6 is a cross-sectional view showing cooling water passages formed in the compressor shown in FIG. 5, taken along line VI—VI of FIG. 5.
Figure 5:
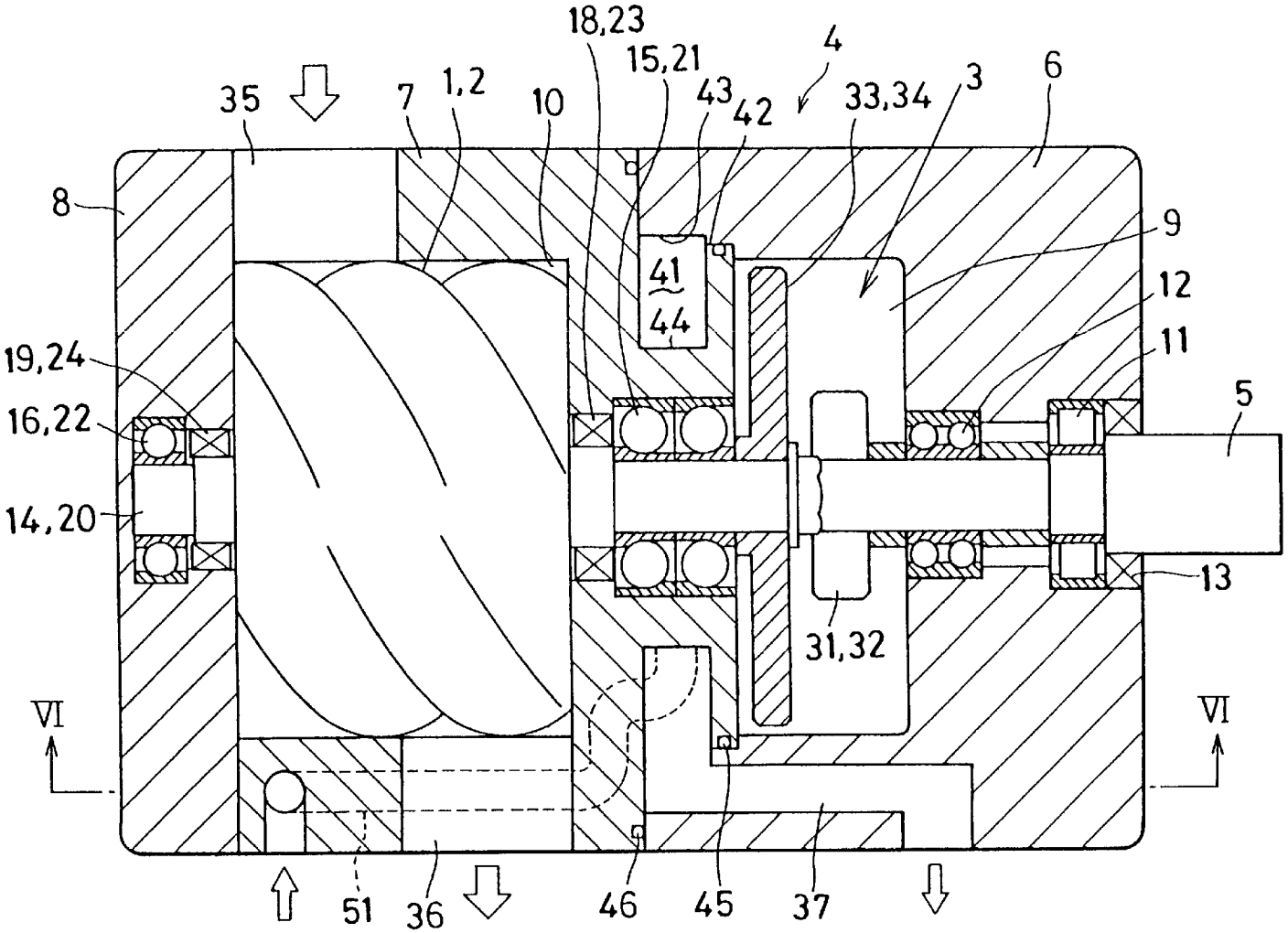
FIG. 5 is a cross-sectional view showing a compressor as a third embodiment of the present invention.

Referring to FIGS. 5 and 6, a third embodiment of the present invention will be described. In this embodiment, a third cooling water passage 51 surrounding at least a part of the outlet port 36 is formed in the rotor housing 7 in addition to the cooling water passages 37 and 41. Other structures are the same as those of the second embodiment described above. The third cooling water passage 51 is connected to the cooling water passage 37 via the second cooling water passage 41. As shown in FIG. 6, in which a cross-sectional view taken along line VI—VI of FIG. 5 is shown, the third cooling water passage 51 is formed around the outlet port 36 in the bottom portion of the rotor housing 7. The compressed fluid at a high temperature delivered from the outlet port 36 is further cooled down by the cooling water flowing through the third passage 51.

Figure 7:
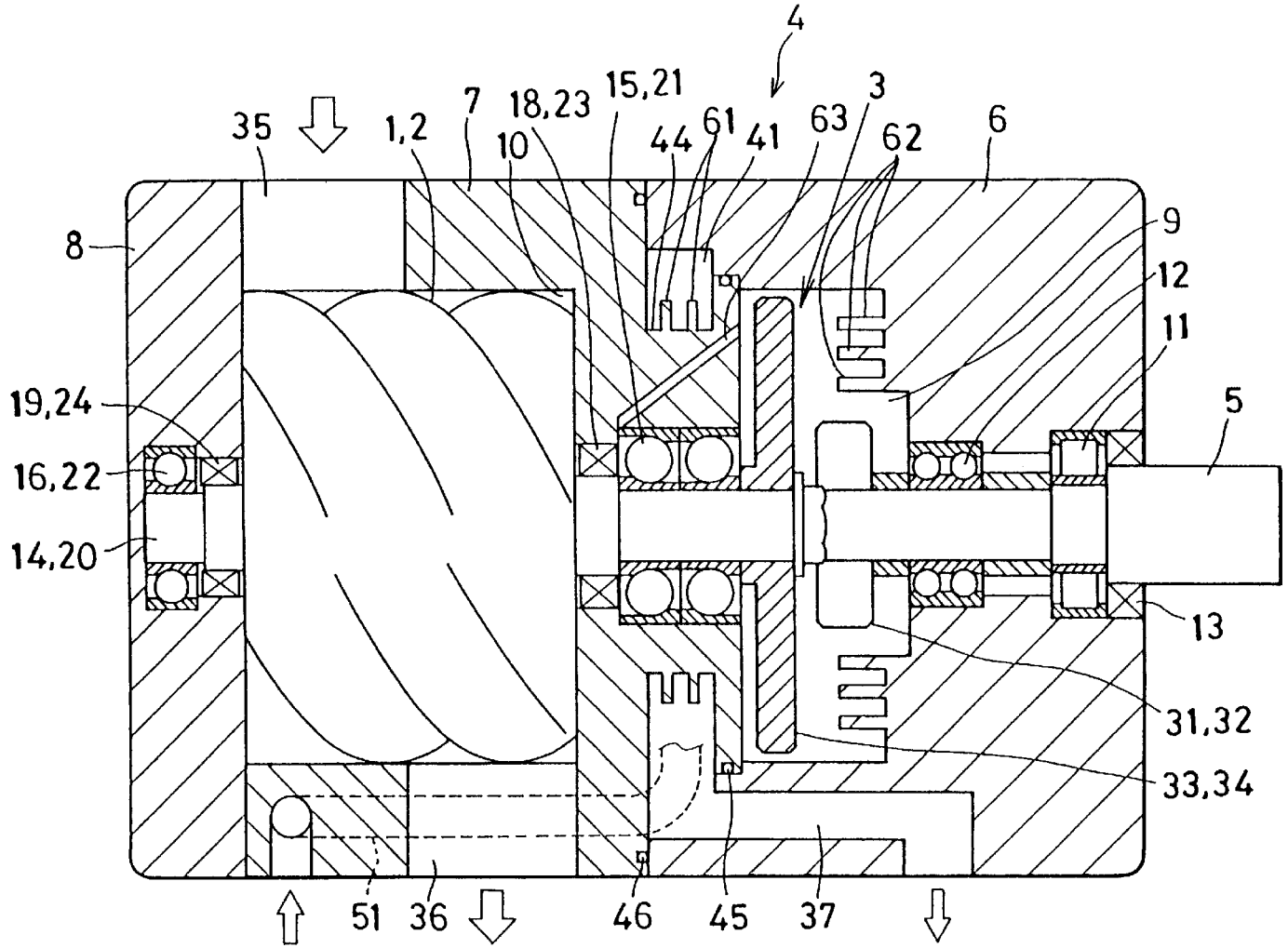
FIG. 7 is a cross-sectional view showing a compressor as a fourth embodiment of the present invention.

A fourth embodiment of the present invention will be described with reference to FIG. 7. In this embodiment, cooling fins 61 are formed on the groove 44 of the second cooling water passage 41 and other cooling fins 62 are formed on an inner wall of the gear chamber 9. Further, a communicating passage 63 connecting an upper portion of the gear chamber 9 and the bearing hole containing the bearings 15, 21 is formed. Other structures are the same as those of the third embodiment described above.

The cooling fins 61 are formed not to interfere with the cooling water flow in the second cooling water passage 41. The bearings 15, 21 held in the separating wall 17 and the rotor housing 7 are effectively cooled by the cooling water flowing through the second cooling water passage 41 having the cooling fins 61. The cooling fins 62 are aligned along an oval path facing two gears 33 and 34, which constitute the timing gears. The surface area of the inner wall facing the gears 33, 34 is increased by the cooling fins 62. Since the lubricant splashed from the bottom of the gear chamber 9 hits the cooling fins 62 and flows through spaces between the cooling fins 62, the lubricant is effectively cooled down thereby to cool the driving mechanism 3 in the gear chamber 6.

Since the bearing hole holding the bearings 15, 21 communicates with the gear chamber 9 through the communicating passage 63, the lubricant is sufficiently supplied to the bearings 15, 21. The bearings 15, 21 which are heated to a high temperature by the compressed fluid in the rotor chamber 10 are effectively cooled down by the lubricant supplied thereto.

Though the present invention is applied to the compressor for compressing fluid such as air in the foregoing embodiments, it may be applied to other compressors for compressing gases such as hydrogen. Though the present invention is applied to the screw-type compressor in the foregoing embodiments, it may be applied to other compressors such as a roots-type compressor.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A compressor for compressing fluid comprising:

a rotor housing forming a rotor chamber therein;

a pair of rotors, each having a rotor shaft, contained in the rotor chamber;

a gear housing connected to the rotor housing, the gear housing forming a gear chamber containing lubricant therein;

a driving mechanism for driving the pair of rotors in synchronism with each other, the driving mechanism being disposed in the gear chamber;

an inlet port for introducing fluid into the rotor chamber and an outlet port for delivering fluid compressed in the rotor chamber to outside, the inlet port being formed in the rotor housing at a position far from the driving mechanism and the outlet port being formed in the rotor housing at a position close to the driving mechanism: and a first cooling water passage for circulating cooling water therethrough, the first cooling water passage being formed in a wall of the gear housing, wherein:

the lubricant contained in the near chamber and the compressed fluid delivered from the outlet port are cooled by the cooling water flowing through the first cooling water passage.

2. The compressor for compressing fluid as in claim 1, wherein:

the first cooling water passage is formed in the gear housing so that the first cooling water passage is positioned at a bottom side of the compressor when the compressor is mounted on a predetermined position.

3. The compressor for compressing fluid as in claim 1, wherein:

one end of each rotor shaft is rotatably supported by respective bearings held in the rotor housing; and a second cooling water passage connected to the first cooling water passage is formed between the rotor housing and the gear housing, so that the second cooling water passage surrounds the bearings.

4. The compressor for compressing fluid as in claim 3, wherein:

the second cooling water passage is formed by combining a groove of the rotor housing with an inner surface of the gear housing.

5. The compressor for compressing fluid as in claim 3, wherein:

a third cooling water passage is formed in the rotor housing to surround at least a part of the outlet port and is connected to the first cooling water passage through the second cooling water passage.

6. The compressor for compressing fluid as in claim 3, wherein:

heat-exchanging fins are formed in the second cooling water passage.

7. The compressor for compressing fluid as in claim 1, wherein:

a third cooling water passage connected to the first cooling water passage is formed in the rotor housing so that the third cooling water passage surrounds at least a part of the outlet port.

8. The compressor for compressing fluid as in claim 1, wherein:

the first cooling water passage and the outlet port are positioned closely to each other.

9. The compressor for compressing fluid as in claim 1, wherein:

the driving mechanism includes a plurality of gears constituting timing gears for rotating one rotor of the pair of rotors in synchronism with the other rotor.

10. The compressor for compressing fluid as in claim 9, wherein:

heat-exchanging fins are formed on an inner wall of the gear housing facing the timing gears, the heat-exchanging fins enlarging a surface area of the inner wall.

* * * * *